US006032507A

United States Patent [19]

McGinty et al.

[11] Patent Number: 6,032,507

[45] Date of Patent: Mar. 7, 2000

[54] PRE-BENDING OF WORKPIECES IN DIES IN NEAR NET WARM FORGING

[75] Inventors: Paul P. G. McGinty, Royal Oak; James Webster, Pleasant Ridge, both of Mich.

[73] Assignee: MSP Industries Corporation, Oxford, Mich.

[21] Appl. No.: 09/144,966

[22] Filed: Sep. 1, 1998

[51] Int. Cl.[7] ..... B21J 13/02

[52] U.S. Cl. ..... 72/356; 72/359; 72/361

[58] Field of Search ..... 72/352, 356, 359, 72/361, 411

[56] References Cited

U.S. PATENT DOCUMENTS 2,014,605 9/1935 Zimmerman et al. ..... 72/361

4,222,260 9/1980 McDermott ..... 72/352

4,426,872 1/1984 Gatny .

*Primary Examiner*—Lowell A. Larson

*Attorney, Agent, or Firm*—Oliff & Berridge, PLC

[57] ABSTRACT

A female die of a closed die set for use in near net warm forging a part includes a cavity having a tapered upper portion and a lower portion. The upper portion is configured to support a workpiece at a preliminary position in the cavity, and to cause the workpiece to be pre-bent as it is moved through the upper portion of the cavity by a punch. The lower portion has a constant length and width so that the workpiece remains in the pre-bent shape during movement through the lower portion to the bottom end of the cavity. The workpiece is finally formed at the bottom end of the cavity to produce the part.

26 Claims, 5 Drawing Sheets

PRE-BENDING OF WORKPIECES IN DIES IN NEAR NET WARM FORGING

BACKGROUND OF THE INVENTION

1. Field of Invention

This invention is directed to metal forging and, more particularly, to apparatuses that can be used in a forging apparatus to near net warm forge parts having complex shapes from axi-symmetrical workpieces (or billets), and also to methods utilizing the apparatuses to produce such parts from such workpieces.

2. Description of Related Art

The forging of small, complex shaped metal parts is problematic. Such parts can be produced by hot forging processes. However, these processes are not completely satisfactory for various reasons, including that hot forging processes result in significant flash (excess material) being formed on parts. This flash must be removed by a machining operation such as grinding, which increases the cost and difficulty of producing the finished parts. Furthermore, hot forging processes inefficiently utilize workpiece material because the flash is waste material. Accordingly, it is desirable to produce such parts by a forging process other than hot forging.

Forging processes that eliminate some of the problems associated with hot forging processes are near net warm forging processes. In near net warm forging processes, the finished parts have a volume substantially equal to the volume of the workpieces (billets). The parts forged by near net warm forging processes typically have only a small amount of excess material or flash that must be removed to finish the parts. This small amount of flash can normally be removed by relatively simple secondary operations. Thus, as compared to hot forging and other forging techniques, near net warm forging processes can reduce processing costs by efficient material utilization, and by simplifying the secondary operations that are necessary to produce the finished parts.

However, while known near net warm forging processes can produce parts of certain relatively simple configurations with high dimensional accuracy, these known near net warm forging apparatuses and processes cannot be employed to effectively manufacture certain complex shaped parts for a number of reasons. Particularly, as stated, to near net warm forge parts, the workpiece volume must be approximately equal to the volume of each finished part. Workpieces that are typically used in warm forging have axi-symmetrical shapes such as generally cylindrical shapes, so that the workpieces readily fit in the die cavities in a single orientation. Stated differently, the workpieces used in warm forging apparatuses and processes are usually axi-symmetrical and elongated along the axis of symmetry so that the workpieces can only fit in the die cavities in a given orientation. For example, the length of the workpiece along the axis may be longer than all dimensions of the cavity other than the length of the cavity, so that the length can only fit in the cavity in one orientation.

The size and geometry of the die cavity are, of course, dependent on the size and shape of the finished parts. However, in some instances, the size and geometry of the die cavity (required to form a particular part configuration) are such that an axi-symmetrical workpiece having the necessary volume to produce the part will not fit in the die cavity. Stated differently, the configuration of a specific part may be such that an axi-symmetrical workpiece having the necessary volume will not fit in the die cavity.

It is not possible to overcome this problem by using a workpiece having a smaller volume than the finished part. Although such underpacked workpieces may fit entirely into the die cavity, the resulting forged parts would be underfilled and, accordingly, defective. Thus, this solution is not satisfactory.

Therefore, known near net warm forging apparatuses and processes are not capable of producing certain parts using axi-symmetrical workpieces that will not fit in the die cavities. Yet, it is desirable to produce such parts by near net warm forging because of the advantages of near net warm forging. Thus, there is a need for apparatuses and methods that can be used to near net warm forge certain complex shaped metal parts that overcome the above-described problems.

SUMMARY OF THE INVENTION

This invention provides female dies of closed die sets, and methods of near net warm forging parts utilizing the female dies, that can be used to manufacture parts when the workpieces do not fit in the die cavities of the female dies. These female dies can be used in conventional closed die sets in combination with conventional forging presses to near net warm forge parts.

The workpieces used in the female dies can be conventional axi-symmetrical workpieces, and can have approximately the same volume as the finished parts. The parts forged from the workpieces can have relatively complex shapes. For example, the parts may include one or more curved side surfaces, one or more planar end surfaces, a top pedestal surface and a bottom surface. A step can be formed on the pedestal surface. A bottom groove can be formed opposite to the step. The present invention is particularly suitable for producing severely curved and tall parts.

The female dies include a top end, a bottom end opposite to the top end, and a cavity comprised of a tapered, upper cavity portion and a straight, lower cavity portion. The upper cavity portion includes opposed upper inner side surfaces and opposed upper inner end surfaces, at least one of which is inwardly tapered. In some embodiments, all of the upper inner surfaces are tapered inwardly towards a bottom surface. In these embodiments, the length and width of the upper cavity portion may decrease continually from the top end to a transition between the upper cavity portion and the lower cavity portion. The dimensions (e.g., width and length) of the lower cavity portion may be constant along its height).

The workpieces are inserted into the upper cavity portion at the top end of the female die. The workpieces have a dimension which is larger than the corresponding dimension in the lower cavity portion. Thus, initially, the workpieces are positioned and held in the upper cavity portion.

The punch of the forging press is then moved into contact with the workpieces during the forging stroke. The punch contacts the preliminarily positioned workpieces and moves the workpieces downwardly along the upper cavity portion. During this movement, the workpieces are initially deformed (pre-bent) by the upper cavity portion. When the workpiece reaches the lower cavity portion, the pre-bent profile, perpendicular to the axis of the punch, does not substantially change. However, as the punch reduces the volume of the cavity to that approaching the volume of the final forging, the workpiece is "brought to fill" until the cavity volume equals the volume of the final forged part.

The present invention overcomes the above-described disadvantages of known apparatuses and processes for forming such parts. Particularly, the present invention can produce certain relatively complex shaped parts utilizing known workpiece configurations even when the workpieces are larger than the cavity, by near net warm forging.

BRIEF DESCRIPTION OF THE DRAWINGS

Certain preferred embodiments of this invention will be described in detail, with reference to the following figures, in which.

DETAILED DESCRIPTION OF PREFERRED EMBODIMENTS

Certain aspects of the present invention are directed to apparatuses that can be used in conventional forging apparatuses to produce certain relatively complex part configurations from axi-symmetrical workpieces by near net warm forging, even when the axi-symmetrical workpieces do not fit in the die cavities.

Figure 1:
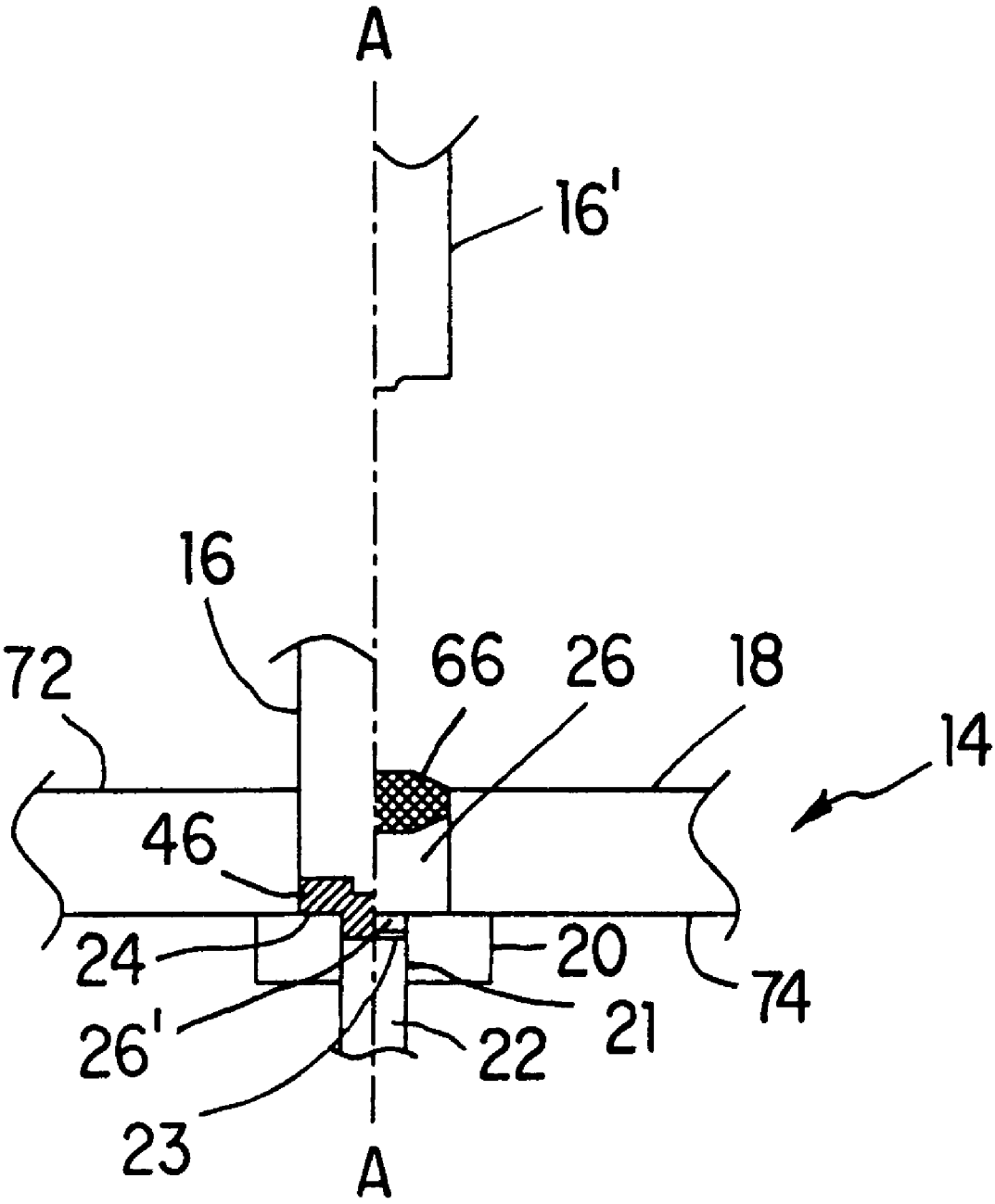
FIG. 1 is a partially broken away, split (along axis A—A) elevational view of a forging press and closed die set including a female die according to an embodiment of the present invention, illustrating the punch in the down position on the left side and in the up position on the right side.

FIG. 1 illustrates a punch 16 of a forging press and a closed die set 14. The forging press (other than punch 16) is not a part of the present invention. Forging presses that are suitable for use with the punch 16 and closed die set 14 are well known in the art and thus not illustrated or described in detail herein.

The punch 16 and the closed die set 14 are oriented along longitudinal axis A—A. During forging, the punch 16 and the closed die set 14 are typically oriented vertically as shown. The punch 16 reciprocates vertically during the forging cycles.

Warm forging processes utilizing a punch 16 and closed die set 14 such as illustrated in FIG. 1 are typically conducted at a temperature range of from about 1200° F. to about 2200° F. The appropriate warm forging temperature used to produce a particular part is dependent on many factors, including the part configuration and composition, and the configuration and composition of the die set.

The closed die set 14 includes an upper female die 18, a die member 20 positioned directly below the female die 18, and an ejector 22. Closed die sets such as die set 14 are well known in the art (except for female die 18 and die member 20) and thus the elements of the closed die set 14 other than female die 18 and die member 20 are not illustrated or described herein.

The female die 18, the die member 20 and the ejector 22 together define the die cavity 26 in which workpieces (or billets) are formed into parts by warm forging. The cavity 26 receives a workpiece such as workpiece 66 (described below) and a punch such as punch 16 during a forging cycle to produce a part such as lug 46. The cavity 26 is open at the top end 72 of the female die 18. The workpieces are placed into the cavity 26 through this opening.

The female die 18 is illustrated in FIGS. 6–9, 11 and 13. The female die 18 includes the top end 72, the bottom end 74 opposite to the top end 72, and various internal surfaces which define, in part, the cavity 26 and extend between the top end 72 and the bottom end 74. The bottom end 74 abuts with upper surface 24 of the die member 20 (see FIG. 1).

The various internal surfaces of the female die 18 which define, in part, the cavity 26 include various opposed curved inner side surfaces and opposed planar inner end surfaces, which, in combination, extend the height of the female die 18 (as defined by central axis A—A). Specifically, in the embodiment illustrated in the figures, the portion of cavity 26 defined by female die 18 is comprised of a tapered, upper cavity portion 84 and a straight, lower cavity portion 86. See FIGS. 7, 9 and 11. The upper cavity portion 84 is defined by opposed planar upper inner end surfaces 88 and opposed curved upper inner side surfaces 89. The upper cavity portion 84 extends from the top end 72 of the female die 18 to a transition 90 between the upper cavity portion 84 and the lower cavity portion 86. The lower cavity portion 86 extends from the transition 90 to the bottom end 74 of the female die 18. The lower cavity portion 86 is defined by opposed planar lower inner end surfaces 92 and opposed curved lower inner side surfaces 91.

The upper inner end surfaces 88 and the upper inner side surfaces 89 of the upper cavity portion 84 are inwardly tapered toward the central axis A—A of the cavity 26, such that, in this embodiment, the length L and the width W of the cavity 26 decrease continuously from the top end 72 of the female die 18 to the transition 90. The taper angle $\beta$ of the upper inner end surfaces 88 and the taper angle $\gamma$ of the upper inner side surfaces 89 are typically from about 2° to about 10°.

Figure 6:
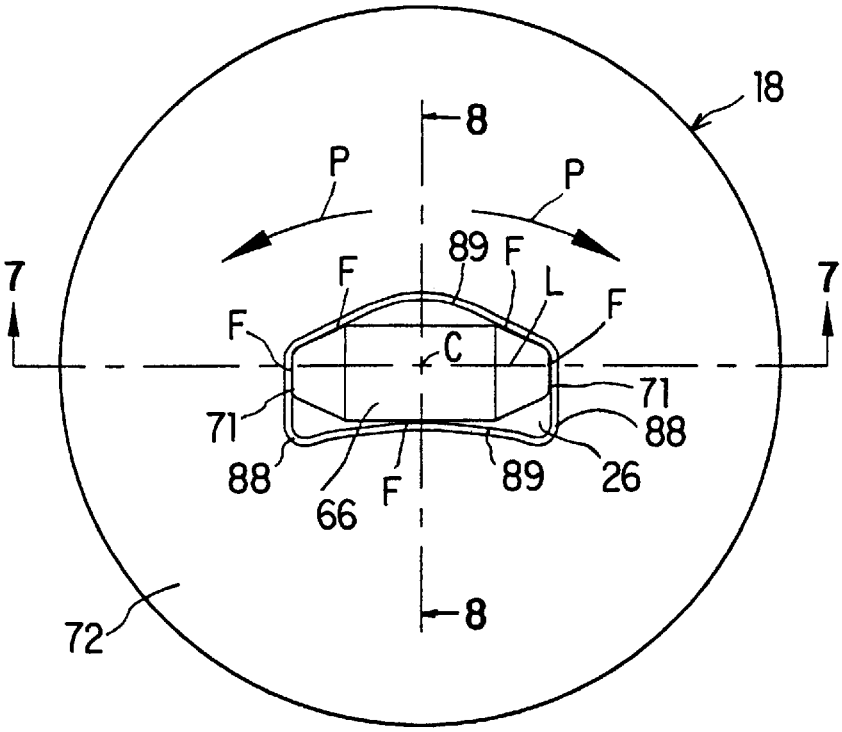
FIG. 6 is a plan view of a female die of one embodiment of the present invention and a workpiece (billet) in the cavity of the die, showing the workpiece located at a preliminary, fixed position in a tapered first cavity portion prior to the punch of the forging press making contact with the workpiece.

As discussed below in detail, the upper cavity portion 84 is sized such that when the workpiece 66 is placed in the cavity 26 in the forging orientation shown in FIG. 6–8, the workpiece 66 is received and held in the upper cavity portion 84. Stated differently, the upper cavity portion 84 and the transition 90 are sized relative to the workpiece 66 such that workpiece 66 is received in the upper cavity portion 84, but cannot fit past the transition 90. Specifically, the upper inner side surfaces 89 and/or the upper inner end surfaces 88 contact and support the workpiece 66 at a fixed, preliminary position between the top end 72 and the transition 90. The workpiece 66 is supported at this preliminary position until being contacted by the punch 16 during the forging stroke, as described in greater detail below. Typically, the workpiece 66 engages the upper inner side surfaces 89 and the upper inner end surfaces 88 at several locations F (see FIG. 6) to retain the workpiece 66 in the preliminary position. As explained above, the angles β and γ can be varied to ensure that there is the desired engagement between the workpiece 66 and the upper inner end surfaces 88 and upper inner side surfaces 89. As shown in FIG. 6, the workpiece 66 is approximately centered in the cavity 26 in its preliminary position.

In other embodiments, it may be necessary or desired to taper only upper inner side surfaces 89 or only the upper inner end surfaces 88, or even to only taper one of these surfaces. Further, while in the embodiment illustrated in the figures these tapers are constant, i.e., upper inner side surfaces 89 and upper inner end surfaces 88 are straight lines, in other embodiments these surfaces could be defined by curved lines, segmented lines or lines having curved and straight portions.

The lower cavity portion 86 of the female die 18 is not tapered in the length dimension L (see FIG. 7) or the width dimension W (see FIG. 8) of the cavity 26. Rather, the lower inner end surfaces 92 and the lower inner side surfaces 91 extend approximately parallel to the central axis A—A of the cavity 26, such that the length L and the width W of the cavity 26 are approximately constant in the lower cavity portion 86.

Referring to FIG. 1, the die member 20 includes side surfaces 21 and the ejector 22 includes an upper surface 23, which surfaces together define a lower portion 26' of the cavity 26. Further, the die member 20 includes the upper surface 24 which supports the workpiece 66 in the female die 18 during the forging cycle of the forging press 12 and forms top pedestal surfaces 56 of lug 46, as discussed below.

As discussed, the punch 16 is sized and shaped to reciprocate in and out of the cavity 26 during the forging stroke. The left side of FIG. 1 (to the left of axis A—A) illustrates the punch 16 in a lowermost position, and the right side of FIG. 1 (to the right of axis A—A) illustrates the punch 16' in an uppermost position. In the right side of FIG. 1, the workpiece 66 is shown in the die cavity 26 prior to the forging/bending cycle. In the left side of FIG. 1, the workpiece 66 has been warm formed into a part 46, as described in greater detail below.

The punch 16 typically comprises curved side surfaces and planar end surfaces (not shown in detail) shaped to mate with inner surfaces of the cavity 26 (i.e., upper inner side surfaces 89 and upper inner end surfaces 88 of upper cavity portion 84, and lower inner side surfaces 91 and lower inner end surfaces 92 of lower cavity portion 86) during the forging stroke. Specifically, the punch 16 is sized and shaped to be received in the lower cavity portion 86. The punch 16 includes a bottom (forming) surface 30 having a nose 32 (see FIG. 7). The punch 16 can be formed of a suitable material such as a tool steel.

Figure 2:
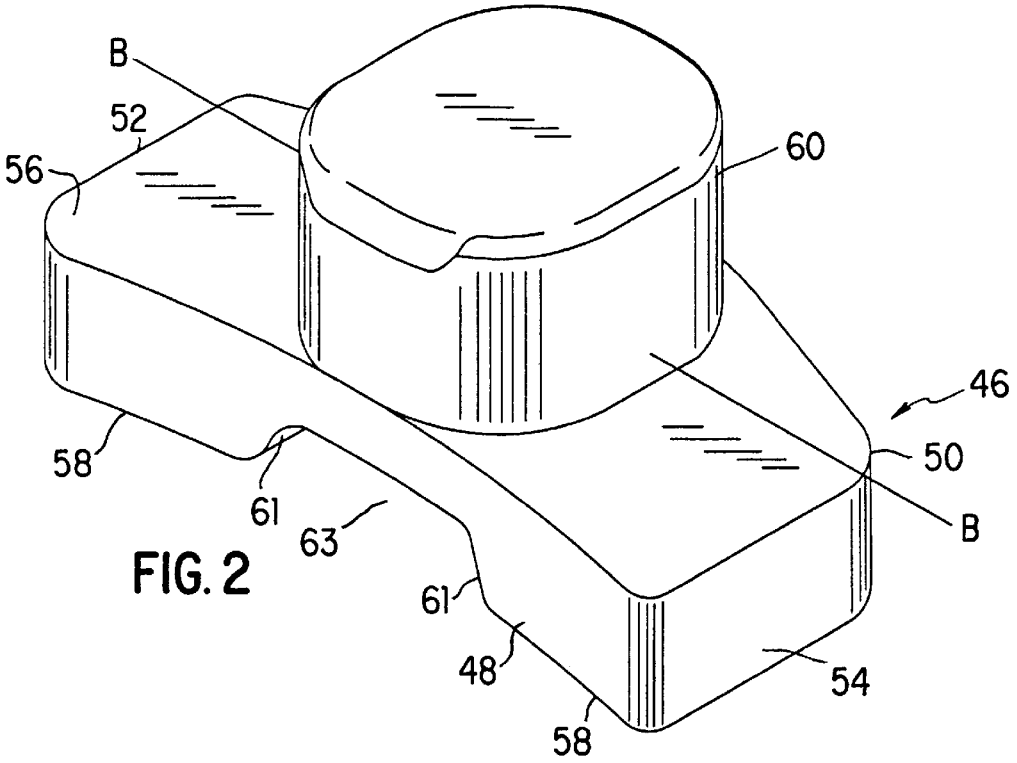
FIG. 2 is a front, top and left side isometric view showing a curved part which can be formed using the apparatus and method of one embodiment of the present invention.
Figure 3:
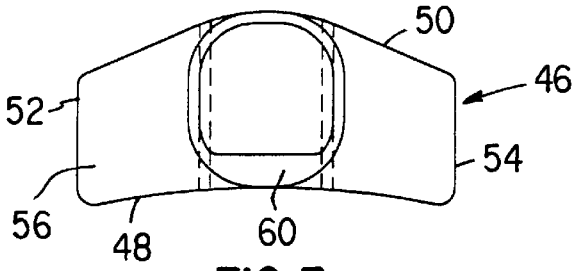
FIG. 3 is a plan view of the part shown in FIG. 2.
Figure 4:
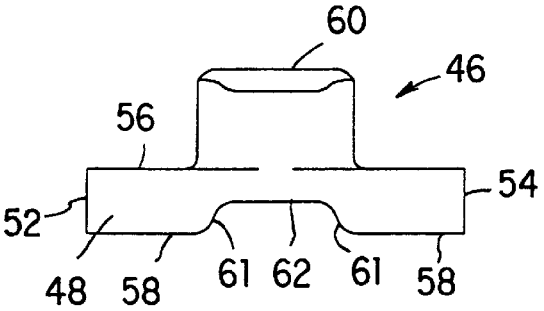
FIG. 4 is a front elevational view of the part of FIG. 2.

FIGS. 2–4 illustrates a part, having a complex configuration, that can be formed by near net warm forging utilizing the die set 14 and punch 16. The illustrated part is a severely curved and tall lug 46. The lug 46 has a longitudinal central axis B—B which defines its length. The lug 46 includes opposed curved side surfaces 48, 50; opposed planar end surfaces 52, 54; a top pedestal surface 56; and bottom surfaces 58 opposite to the pedestal surface 56. The pedestal surface 56 and bottom surfaces 58 are typically flat and oriented approximately perpendicular to the planar end surfaces 52, 54. A step 60 protrudes from the pedestal surface 56 approximately centrally along the longitudinal central axis B—B. Opposed surfaces 61 and surface 62 define a bottom groove 63 opposite to the step 60.

The lug 46 is just one example of the part configurations that can be manufactured by the apparatuses and processes of this invention. Many other part configurations having various curved surfaces, segmented surfaces, protrusions, grooves and the like, can be manufactured using the apparatuses and processes of this invention.

Figure 5:
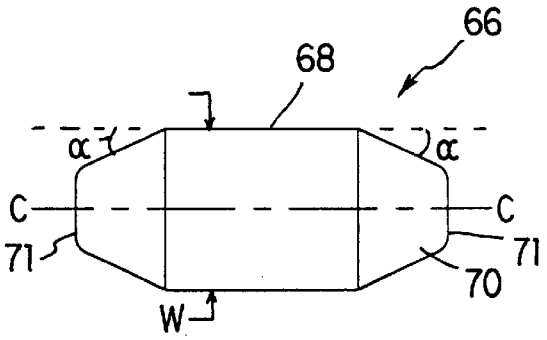
FIG. 5 illustrates an exemplary workpiece (billet) configuration that can be used in certain embodiments of the present invention to near net warm forge parts such as the parts illustrated in FIGS. 2–4.

FIG. 5 illustrates a workpiece configuration, workpiece 66, which can be used in the closed die set 14 to produce parts such as lug 46 illustrated in FIGS. 2–4. The workpiece 66 is symmetrical along a longitudinal central axis C—C, which defines the length of the workpiece 66. The workpiece 66 is generally cylindrically shaped and includes a cylindrical central portion 68 having the maximum width of the workpiece 66, conical end portions 70 and opposed end surfaces 71. The end portions 70 are oriented at an angle α relative to the central portion 68. For the illustrated lug 46, this angle is typically from about 10° to about 40°. By varying this angle, the width of the end surfaces 71 can be varied and the volume of the workpiece 66 can be adjusted to approximately equal the specified volume of the finished part. In addition, this angle can be varied to ensure that the workpiece 66 (i.e., in upper cavity portion 84) is properly supported in the cavity 26 of the female die 18 at the preliminary position prior to warm forming as discussed above. Further, workpieces can be employed in certain situations which do not have conical end portions 70.

It will be understood by those skilled in the art that the workpieces used in the present apparatuses and methods can have axi-symmetrical shapes other than shown in FIG. 5. For example, the workpieces can have other generally cylindrical shapes or oval shapes (not shown).

Punch 16 and die set 14 interact to form the lug 46 from the workpiece 66 as follows. Punch 16 starts in the up position. Workpiece 66 is heated to the appropriate temperature and inserted in the cavity 26.

As discussed above, the workpiece 66 and the cavity 26 are relatively sized and shaped such that workpiece 66 is initially received within upper cavity portion 84. See FIGS. 7 and 8. The workpiece 66 must be pre-bent from its initial shape shown in FIG. 5 to fit into the lower cavity portion 86. This pre-bending occurs during the forging stroke of punch 16 and is illustrated by FIGS. 8–13. In summary, the upper cavity portion 84 is inwardly tapered so that during the forging stroke of the punch 16, the workpiece 66 is pre-bent in the upper cavity portion 84, enabling the pre-bent workpiece to be moved downwardly into the lower cavity portion 86 and be finally formed at the bottom end 74 of the female die 18.

Figure 7:
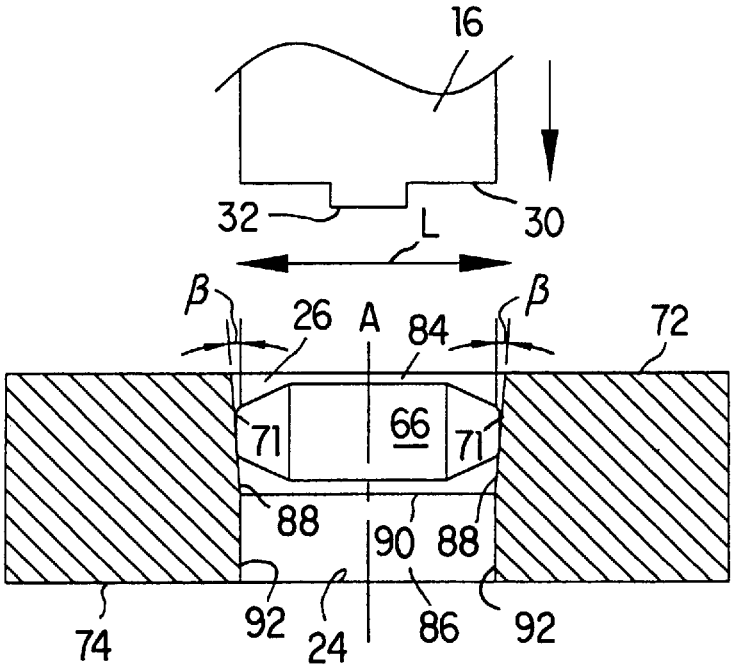
FIG. 7 is a cross-sectional view in the direction of line 7—7 of FIG. 6.
Figure 8:
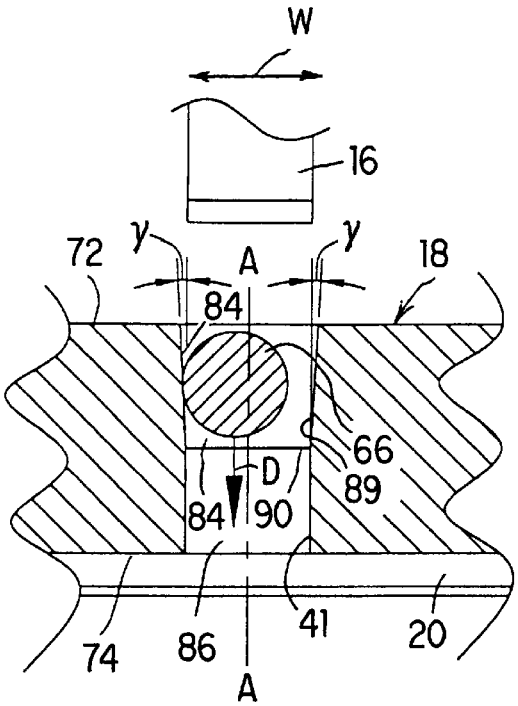
FIG. 8 is a cross-sectional view in the direction of line 8—8 of FIG. 6.

Particularly, as stated and as shown in FIGS. 7 and 8, the workpiece 66 is initially received in the upper cavity portion 84 above the transition 90. In this preliminary position, the workpiece 66 has its initial, non-deformed shape, as shown in FIG. 5.

Figure 9:
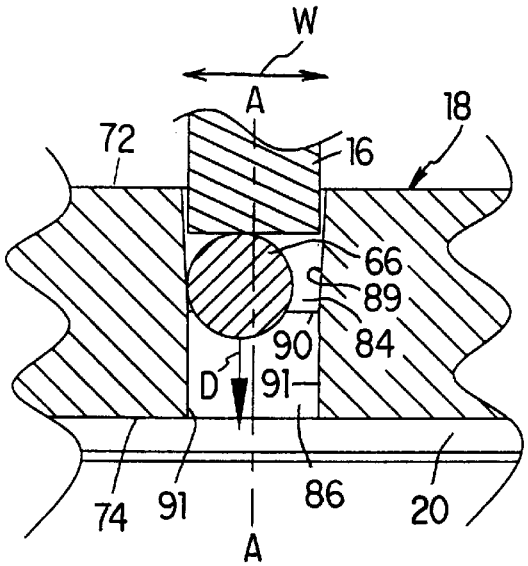
FIG. 9 is a cross-sectional view of the female die and workpiece of FIG. 6, illustrating the workpiece located at a lower second position in the upper cavity portion after contact between the workpiece and the punch of the forging press.
Figure 10:
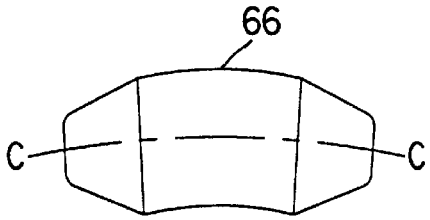
FIG. 10 is a top view of the workpiece illustrating the shape of the workpiece at the second position of FIG. 9.
Figure 11:
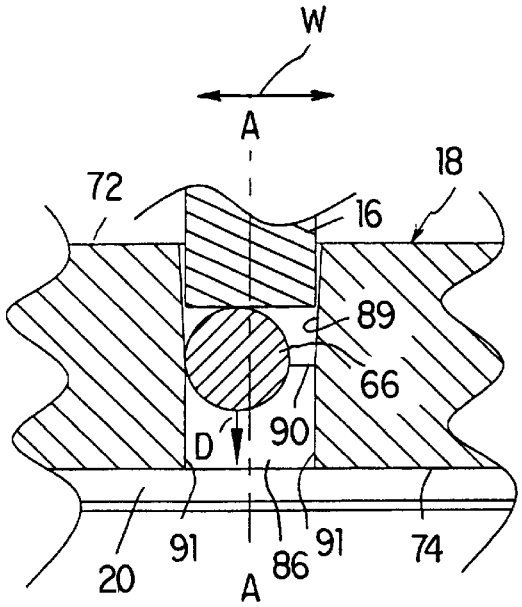
FIG. 11 is a cross-sectional view of the female die and workpiece of FIG. 6, illustrating the workpiece located at a lower third position at a transition between the upper cavity portion and a lower cavity portion of the die cavity.
Figure 12:
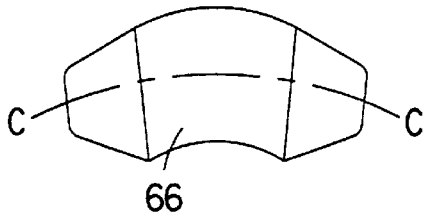
FIG. 12 is a top view of the workpiece illustrating the shape of the workpiece at the third position of FIG. 11.

The punch 16 is then lowered and engages the workpiece 66 and pushes the workpiece 66 downward to the transition 90 in direction D shown in FIGS. 8, 9 and 11. The taper of the upper inner side surfaces 89 causes the workpiece 66 to pre-bend. Stated differently, during this movement of the punch 16, the punch 16 engages the workpiece 66 and pushes the workpiece 66 through the upper cavity portion 84 to the transition 90. During this movement, the workpiece 66 is pre-bent by the interaction between the upper inner side surfaces 89 and workpiece 66 itself under the action of the punch 16. The arrows P in FIG. 6 represent the direction of pre-bending of the workpiece 66 that occurs.

FIG. 9 shows the workpiece 66 located at a lower second position in the upper cavity portion 84 after the punch 16 contacts the workpiece 66 supported at the preliminary position of FIG. 8 and moves the workpiece 66 downwardly along the height of the upper cavity portion 84, but before the workpiece reaches the transition 90. This movement causes the shape of the workpiece 66 to change from the initial shape shown in FIG. 5 to the shape illustrated in FIG. 10. Particularly, the workpiece 66 is partially pre-bent along the longitudinal central axis C—C and has a curved configuration.

As the workpiece 66 is moved further downward in the upper cavity portion 84 by the punch 16, the workpiece 66 is further pre-bent by contact with the upper inner side surfaces 89 due to their inward taper (decreasing width). This pre-bending continues as the workpiece 66 is moved further downward along the cavity 26 until the workpiece 66 is located at the transition 90 between the upper cavity portion 84 and the lower cavity portion 86, as shown in FIG. 11. At this location of the cavity 26, the workpiece 66 is fully pre-bent in the shape depicted in FIG. 12. The workpiece 66 has a more curved shape as compared to the shape shown in FIG. 10.

The fully pre-bent shape of the workpiece 66 can fit into the lower cavity portion 86 because the lower inner side surfaces 91 and the lower inner end surfaces 92 are not tapered. Accordingly, as the punch 16 continues its downward stroke, the punch 16 moves the fully pre-bent workpiece 66 from the transition 90 into the lower cavity portion 86 without any further bending of the workpiece 66. The shape of the workpiece 66 does not change substantially from the fully pre-bent shape shown in FIG. 12 until the workpiece 66 engages the surface 24 of die member 20 and is finally formed by the punch 16.

Figure 13:
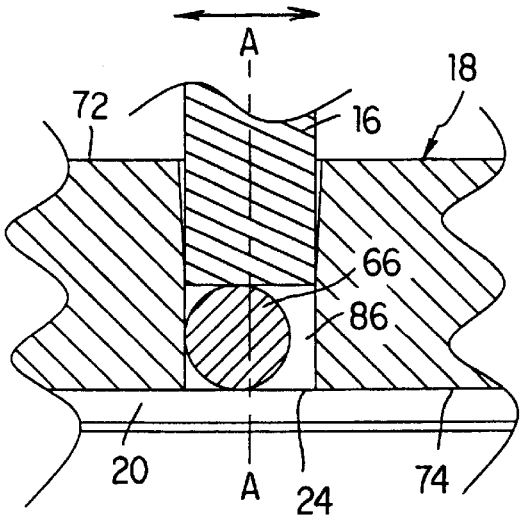
FIG. 13 is a cross-sectional view of the female die and workpiece of FIG. 6, illustrating the workpiece seated at a bottom end of the lower cavity portion, prior to final forming of the workpiece.

Specifically, FIG. 13 shows the workpiece 66 seated at the bottom end 74 of the female die 18, supported by the top surface 24 of the die member 20. Continued downward movement of the punch toward the bottom end 74 causes the workpiece 66 to be finally formed, producing a part such as the lug 46 shown in FIGS. 2–4. During final forming, the nose 32 (see FIG. 6) of the punch 16 forms the groove 63 in the part 46. The step 60 is formed at the top pedestal surface 56 of the lug 46 in the lower portion 26' of the cavity 26.

The finally formed part is ejected from the cavity 26 of the female die 18 by actuating the ejector 22 (see FIG. 1). The warm forging process can then be repeated by raising the punch 16, placing another properly heated workpiece 66 into the upper cavity portion 84 of the cavity 26, and moving the punch through its forging stroke.

Accordingly, the apparatuses and processes of this invention can be utilized to produce near net warm forged parts having complex configurations using conventional workpiece shapes, even if the workpieces do not fit into the cavities. Workpieces having substantially the same volume as the finished part can be used in the female dies, enabling the production of fully filled parts. In addition, the forged parts typically have only a minimal amount of flash and can be easily finished by a minor secondary finishing operation. For example, it possible to finish the parts by tumbling a plurality of as-forged parts together in a tumbler.

While the invention has been described in conjunction with the specific embodiments described above, it is evident that many alternatives, modifications and variations are apparent to those skilled in the art. Accordingly, the preferred embodiments of the invention as set forth above are intended to be illustrative and not limiting. Various changes can be made without departing from the spirit and scope of the invention as defined in the following claims.

What is claimed is:

1. A female die for use with a punch to near net warm forge a workpiece to produce a part, the female die including an open top end, a bottom end opposite to the top end and internal surfaces defining a cavity extending between the top end and the bottom end, the punch being movable in the cavity during the forging stroke to form the workpiece into the part, the internal surfaces of the female die comprising:

upper inner surfaces defining an upper cavity portion which extends from the top end of the female die to a transition, the upper inner surfaces being inwardly tapered such that a width and a length of the upper cavity portion decrease from the top end to the transition; and lower inner surfaces defining a lower cavity portion which extends between the transition and the bottom end of the female die, the lower cavity portion having an approximately constant width and length from between the transition and the bottom end;

wherein (i) the upper cavity portion is configured to receive the workpiece in a forging orientation through the top end, and the workpiece is sized such that it is too large to be fitted into the lower cavity portion in the forging orientation, (ii) the upper inner surfaces contact and support the workpiece at a preliminary position prior to the punch contacting the workpiece during the forging stroke, (iii) the workpiece being pre-bent by a reaction between the upper inner surfaces and the workpiece itself under the action of the punch during movement of the workpiece through the upper cavity portion between the preliminary position and the transition, and (iv) the pre-bent workpiece is configured such that it is movable into the lower cavity portion by the punch during the forging stroke.

2. The female die of claim 1, wherein (i) the workpiece is fully pre-bent when disposed at approximately the transition, (ii) the workpiece has substantially the fully pre-bent configuration when moved by the punch into the lower cavity portion and moved between the transition and the bottom end of the female die, and (iii) the workpiece is finally formed by the punch to produce the part at the bottom end.

3. The female die of claim 1, wherein:

the upper inner surfaces of the upper cavity portion includes opposed upper inner end surfaces and opposed upper inner side surfaces;

the workpiece is axi-symmetrical and includes a cylindrical central portion, conical end portions disposed at opposite sides of the central portion and opposed end surfaces; and the upper inner side surfaces of the upper cavity portion are configured to engage the central portion and the end portions so as to support the workpiece at the preliminary position in the cavity, and the upper inner end surfaces of the upper cavity portion being configured to engage the end surfaces of the workpiece.

4. The female die of claim 1, wherein the upper inner surfaces of the upper cavity portion are inwardly tapered toward a central axis at an angle of from about 2° to about 10° from between the top end of the female die to the transition.

5. The female die of claim 1, wherein the part includes a longitudinal central axis, a pair of curved side surfaces, a pair of planar end surfaces, a top pedestal surface including a step, and a bottom groove opposite to the step.

6. A female die for use with a punch to near net warm forge an axi-symmetrical workpiece to produce a part, the female die comprising:

an open top end;

a bottom end opposite to the top end; and surfaces defining a cavity extending between the top end and the bottom end;

the cavity having a central axis defining a height of the cavity;

the surfaces defining the cavity including:

upper inner surfaces defining an upper cavity portion which extends along the height of the cavity from the top end of the female die to a transition, the upper inner surfaces being inwardly tapered toward the bottom end at an angle of from about 2° to about 10°; and lower inner surfaces defining a lower cavity portion which extends from the transition to the bottom end, the lower inner surfaces extending approximately parallel to the central axis from between the transition and the bottom end of the female die such the lower cavity portion has an approximately constant length and width;

wherein (i) the workpiece having an initial configuration can be placed into the upper cavity portion in a forging orientation in which the upper inner surfaces contact and support the workpiece at a preliminary position in the upper cavity portion prior to the punch contacting the workpiece during the forging stroke, (ii) the workpiece having the initial configuration has a width exceeding the width of the lower cavity portion, (iii) the workpiece is pre-bent by a reaction between the upper inner surfaces and the workpiece itself under the action of the punch during movement of the workpiece through the upper cavity portion between the preliminary position and the transition, (iv) the pre-bent workpiece is configured such that it is movable into the lower cavity portion by the punch during the forging stroke, (v) the workpiece is fully pre-bent when disposed at approximately the transition, (vi) the workpiece has substantially the fully pre-bent configuration when moved by the punch into the lower cavity portion and moved between the transition and the bottom end of the female die, and (vii) the workpiece is finally formed by the punch to produce the part at the bottom end.

7. The female die of claim 6, wherein:

the workpiece includes a cylindrical central portion, conical end portions disposed at opposite sides of the central portion and opposed end surfaces; and upper inner side surfaces of the upper cavity portion engage the central portion and the end portions to support the workpiece at the preliminary position in the cavity, and upper inner end surfaces of the upper cavity portion engage the end surfaces of the workpiece.

8. The female die of claim 6, wherein the part includes a longitudinal central axis, a pair of curved side surfaces, a pair of planar end surfaces, a top pedestal surface including a step, and a bottom groove opposite to the step.

9. In a female die for use with a punch to near net warm forge a workpiece to produce a part, the female die including an open top end, a bottom end opposite to the top end and internal surfaces defining a cavity extending between the top end and the bottom end, the punch being movable in the cavity during the forging stroke to form the workpiece into the part, the improvement comprising:

the internal surfaces of the female die including:

upper inner surfaces defining an upper cavity portion which extends from the top end of the female die to a transition, the upper inner surfaces being inwardly tapered toward the bottom end such that a width and a length of the upper cavity portion decrease from the top end to the transition; and lower inner surfaces defining a lower cavity portion which extends between the transition and the bottom end of the female die, the lower cavity portion having an approximately constant width and length from between the transition and the bottom end;

wherein (i) the upper cavity portion is configured to receive the workpiece in a forging orientation through the top end, and the workpiece is sized such that it is too large to be fitted into the lower cavity portion in the forging orientation, (ii) the upper inner surfaces contact and support the workpiece at a preliminary position prior to the punch contacting the workpiece during the forging stroke, (iii) the workpiece being pre-bent by a reaction between the upper inner surfaces and the workpiece itself under the action of the punch during movement of the workpiece through the upper cavity portion between the preliminary position and the transition, and (iv) the pre-bent workpiece is configured such that it is movable into the lower cavity portion by the punch during the forging stroke.

10. The female die of claim 9, wherein (i) the workpiece is fully pre-bent when disposed at approximately the transition, (ii) the workpiece has substantially the fully pre-bent configuration when moved by the punch into the lower cavity portion and moved between the transition and the bottom end of the female die, and (iii) the workpiece is finally formed by the punch to produce the part at the bottom end.

11. The female die of claim 9, wherein:

the upper inner surfaces of the upper cavity portion includes opposed upper inner end surfaces and opposed upper inner side surfaces;

the workpiece is axi-symmetrical and includes a cylindrical central portion, conical end portions disposed at opposite sides of the central portion and opposed end surfaces; and the upper inner side surfaces of the upper cavity portion being configured to engage the central portion and the end portions to support the workpiece at the preliminary position in the cavity, and the upper inner end surfaces of the upper cavity portion being configured to engage the end surfaces of the workpiece.

12. The female die of claim 9, wherein the upper inner surfaces of the upper cavity portion are inwardly tapered toward the bottom end at an angle of from about 2° to about 10° from between the top end of the female die to the transition.

13. A female die for use with a punch to near net warm forge a workpiece to produce a part, the female die including an open top end, a bottom end opposite to the top end and internal surfaces defining a cavity extending between the top end and the bottom end, the punch being movable in the cavity during the forging stroke to form the workpiece into the part, the internal surfaces of the female die comprising:

upper inner surfaces defining an upper cavity portion which extends from the top end of the female die to a transition, at least one of the upper inner surfaces being inwardly tapered toward a central axis such that at least one of a width and a length of the upper cavity portion decreases from the top end to the transition; and lower inner surfaces defining a lower cavity portion which extends between the transition and the bottom end of the female die, the lower cavity portion having an approximately constant width and length from between the transition and the bottom end;

wherein (i) the upper cavity portion is configured to receive the workpiece in a forging orientation through the top end, and the workpiece is sized such that it is too large to be fitted into the lower cavity portion in the forging orientation, (ii) the upper inner surfaces contact and support the workpiece at a preliminary position prior to the punch contacting the workpiece during the forging stroke, (iii) the workpiece being pre-bent by a reaction between the upper inner surfaces and the workpiece itself under the action of the punch during movement of the workpiece through the upper cavity portion between the preliminary position and the transition, and (iv) the pre-bent workpiece is configured such that it is movable into the lower cavity portion by the punch during the forging stroke.

14. A method of near net warm forging an axisymmetrical workpiece to produce a part, comprising the steps of:

providing a punch and a female die, the female die including an open top end, a bottom end opposite to the top end, and inner side surfaces defining a cavity extending between the top end and the bottom end, the inner side surfaces including:

upper inner surfaces defining an upper cavity portion which extends along the height of the cavity from the top end of the female die to a transition, the upper cavity portion having a width and a length defined by the upper inner surfaces, at least one of the width and the length decreasing from the top end to the transition; and lower inner surfaces defining a lower cavity portion which extends along the height of the cavity from the transition to the bottom end of the female die, the lower cavity portion having an approximately constant width and an approximately constant length;

placing the workpiece having an initial configuration into the upper cavity portion in a forging orientation through the top end of the cavity, the upper inner surfaces supporting the workpiece at a preliminary position in the upper cavity portion, the initial configuration of the workpiece having a dimension exceeding the matching dimension of the lower cavity portion;

moving the punch along the height of the cavity so that the workpiece is pre-bent from the initial configuration by a reaction between the upper inner surfaces and the workpiece itself under the action of the punch during movement of the workpiece through the upper cavity portion between the preliminary position and the transition;

advancing the punch along the height of the cavity so that the pre-bent workpiece is moved from the transition into the lower cavity portion and to the bottom end of the female die; and finally forming the pre-bent workpiece with the punch at the bottom end of the female die to produce the part.

15. The method of claim 14, wherein the upper inner surfaces of the upper cavity portion of the female die are inwardly tapered toward the bottom end at an angle of from about 2° to about 10° from the top end of the female die to the transition such that the length and the width of the upper cavity portion continuously decrease from the top end to the transition.

16. The method of claim 14, wherein (i) the workpiece is continuously pre-bent by the reaction between the upper inner surfaces and the workpiece itself under the action of the punch during movement of the workpiece through the upper cavity portion between the preliminary position and the transition, (ii) the workpiece is fully pre-bent when located at the transition, and (iii) the workpiece retains substantially the fully pre-bent shape when moved through the cavity by the punch between the transition and the bottom end of the female die, prior to the step of finally forming.

17. The method of claim 14, wherein the part includes a longitudinal central axis, opposed curved side surfaces, opposed planar end surfaces, a top pedestal surface including a step, and a bottom groove opposite to the step.

18. The method of claim 14, wherein:

the upper inner surfaces include opposed upper inner side surfaces and opposed upper inner end surfaces;

the workpiece includes a cylindrical central portion, conical end portions disposed respectively at opposite sides of the central portion, and opposed end surfaces; and the upper inner side surfaces of the upper cavity portion are configured to (i) engage the central portion and each of the end portions to support the workpiece at the preliminary position in the cavity, and (ii) cause the workpiece to be pre-bent during movement of the workpiece through the upper cavity portion between the preliminary position and the transition.

19. The method of claim 14, further comprising the step of heating the workpiece to a temperature of from about 1200° F. to about 2200° F. prior to being pre-bent by the punch.

20. A method of producing a finished lug, comprising the steps of:

providing a punch and a female die, the female die including an open top end, a bottom end opposite to the top end, and surfaces extending between the top and bottom ends defining a cavity including:

upper inner surfaces including opposed upper inner end surfaces and opposed upper inner side surfaces defining an upper cavity portion which extends along the height of the cavity from the top end of the female die to a transition, at least one of the upper inner surfaces being inwardly tapered toward the bottom end from the top end of the female die to the transition such that at least one of a length defined by the upper inner end surfaces and a width defined by the upper inner side surfaces decrease between the top end and the transition; and lower inner surfaces defining a lower cavity portion which extends from between the transition to the bottom end of the female die, the lower cavity portion having an approximately constant length and width;

placing a workpiece having an initial configuration into the upper cavity portion through the top end of the cavity such that the upper inner side surfaces support the workpiece at a preliminary position in the upper cavity portion, the workpiece having a dimension in the initial configuration exceeding the complementary dimension of the lower cavity portion;

moving the punch along the height of the cavity so that the punch contacts the supported workpiece and causes the workpiece to be pre-bent from the initial configuration by a reaction between the upper inner side surfaces and the workpiece itself under the action of the punch during movement of the workpiece through the upper cavity portion between the preliminary position and the transition;

advancing the punch along the height of the cavity so that the workpiece is moved from the transition into the lower cavity portion and to the bottom end of the female die;

finally forming the pre-bent workpiece with the punch at the bottom end of the female die to produce a forged lug;

removing the forged lug from the cavity; and finishing the forged lug to produce the finished lug, the finished lug having substantially the same volume as the workpiece.

21. The method of claim 20, wherein the upper inner side surfaces and the upper inner end surfaces of the upper cavity portion are inwardly tapered toward the bottom end at an angle of from about 2° to about 10°.

22. The method of claim 20, wherein (i) the workpiece is continuously pre-bent by the reaction between the upper inner side surfaces and the workpiece itself under the action of the punch during movement of the workpiece through the upper cavity portion between the preliminary position and the transition, (ii) the workpiece is substantially fully pre-bent when located at the transition, and (iii) the workpiece retains substantially the fully pre-bent shape when moved through the cavity by the punch between approximately the transition and the bottom end of the female die, prior to the step of finally forming.

23. The method of claim 20, wherein the finished lug includes a longitudinal central axis, opposed curved side surfaces, opposed planar end surfaces, a top surface including a step, and a bottom groove opposite to the step.

24. The method of claim 20, wherein the workpiece is generally cylindrical shaped and includes a cylindrical central portion, conical end portions disposed at opposite sides of the central portion and opposed end surfaces, the upper inner side surfaces of the upper cavity portion being configured to (i) engage the central portion and the end portions to support the workpiece at the preliminary position in the cavity, and (ii) cause the workpiece to be pre-bent during movement of the workpiece through the upper cavity portion between the preliminary position and the transition, and the upper inner end surfaces engage the end surfaces in the preliminary position.

25. The method of claim 20, wherein the step of finishing the forged lug comprises finishing the forged lug in a tumbler.

26. The method of claim 20, further comprising the step of heating the workpiece to a temperature of from about 1200° F. to about 2200° F. prior to being pre-bent by the punch.

* * * * *